US008183167B1

(12) United States Patent
Delattre et al.

(10) Patent No.: US 8,183,167 B1
(45) Date of Patent: May 22, 2012

(54) WASH-DURABLE, ANTIMICROBIAL AND ANTIFUNGAL TEXTILE SUBSTRATES

(75) Inventors: James L. Delattre, State College, PA (US); Daniel J. Hayes, State College, PA (US); Joseph Cuiffi, Fort Myers, FL (US); Matthew Henry, State College, PA (US); James Kundrat, State College, PA (US); Paul Carrigan, State College, PA (US)

(73) Assignee: NanoHorizons, Inc., State College, PA (US)

( * ) Notice: Subject to any disclaimer, the term of this patent is extended or adjusted under 35 U.S.C. 154(b) by 0 days.

(21) Appl. No.: 12/016,555

(22) Filed: Jan. 18, 2008

Related U.S. Application Data

(60) Provisional application No. 60/885,758, filed on Jan. 19, 2007.

(51) Int. Cl.
*D03D 15/00* (2006.01)
*D04H 1/00* (2006.01)
*D02G 3/00* (2006.01)

(52) U.S. Cl. ..... 442/192; 442/189; 442/301; 442/414; 442/415; 442/417; 428/372

(58) Field of Classification Search ..... 442/123, 442/124, 152, 153, 164, 189, 192, 301, 414, 442/415, 417; 428/372
See application file for complete search history.

(56) References Cited

U.S. PATENT DOCUMENTS

| | | | | |
|---|---|---|---|---|
| 5,180,402 | A * | 1/1993 | Kubota et al. | 8/490 |
| 6,584,668 | B2 * | 7/2003 | Green et al. | 29/527.2 |
| 6,723,428 | B1 * | 4/2004 | Foss et al. | 428/370 |
| 6,979,491 | B2 * | 12/2005 | Yan et al. | 428/361 |
| 2004/0247653 | A1 * | 12/2004 | Gabbay | 424/443 |
| 2005/0229328 | A1 * | 10/2005 | Tran | 8/115.51 |
| 2008/0152905 | A1 * | 6/2008 | Hendriks et al. | 428/365 |

OTHER PUBLICATIONS

JP 07-238421 A. Teijin Ltd. Dec. 9, 1995. English Abstract and English Translation of the Japanese publication.*
Dimensional Changes of Fabrics after Home Laundering, Test Method 135-2004, AATCC Technical Manual, 2006, 231-234, AATCC, Triangle Park, NC, USA.
Antifungal Activity, Assessment on Textile Materials: Mildew and Rot Resistance of Textile Materials, Test Method 30-2004, AATCC Technical Manual, 2006, 81-84, AATCC, Triangle Park, NC, USA.
Antibacterial Finishes on Textile Materials: Assessment of, Test Method 100-2004, AATCC Technical Manual, 2007, 145-147, AATCC, Triangle Park, NC, USA.

* cited by examiner

*Primary Examiner* — Jenna Johnson
(74) *Attorney, Agent, or Firm* — Design IP

(57) ABSTRACT

Substrates that exhibit antimicrobial and/or antifungal characteristics that persist through the useful life of the substrate, and more particularly textile substrates infused with or covalently bound to well-dispersed antimicrobial nanoparticles, such as silver and/or copper nanoparticles, which exhibit persistent and demonstrable bacteriocidal, bacteriostatic, fungicidal, fungistatic behavior through numerous wash cycles. Methods of manufacturing such substrates are also provided.

24 Claims, No Drawings

WASH-DURABLE, ANTIMICROBIAL AND ANTIFUNGAL TEXTILE SUBSTRATES

CROSS REFERENCE TO RELATED APPLICATIONS

This application claims the priority of U.S. patent application No. 60/885,758, which was filed on Jan. 19, 2007 and which is incorporated herein by reference in its entirety.

FIELD

Disclosed herein are substrates that exhibit antimicrobial and antifungal characteristics that persist through the useful life of the substrate, and more particularly to textile substrates infused with or covalently bound to well-dispersed antimicrobial nanoparticles, such as silver and/or copper nanoparticles, which exhibit persistent and demonstrable bacteriocidal/bacteriostatic and/or fungicidal/fungistatic behavior through numerous wash cycles.

BACKGROUND

It is a longstanding requirement of the textiles industry that substrates used in apparel manufacture, such as fabrics and fibers for clothing, exhibit special properties that persist through numerous washings. One such special property of increasing interest is antibacterial and antifungal performance. Antibacterial and/or antifungal effects are typically achieved by loading the fabric substrate with a biocide or fungicide that is released under a certain set of environmental conditions. For most inorganic biocides, such as silver and copper, water based corrosion is the primary method for the release of metal ions responsible for killing microbes and/or fungi. Consequently, the provision of antimicrobial performance with wash-durability is difficult to achieve because washing conditions accelerate the release of water-soluble antimicrobial and antifungal agents. If release of antimicrobial or antifungal agent occurs too quickly or there is an insufficient "reservoir" of the agent, the fabric will be depleted prematurely, leaving the fabric substrate unprotected from infestation.

The related art is characterized by a variety of inorganic agents, mainly zeolites and metal particles that release antimicrobial or antifungal metal ions such as $Ag^+$, $Zn^{2+}$, $Cu^{2+}$. One general approach for manufacturing fabric substrates laden with inorganic agent involves methods such as soak or pad application to fabric substrates after they have been woven. Alternatively, inorganic agents could be mixed with polymers and extruded into fibers, although known extrusion attempts to date are rife with problems, such as inconsistent concentration and dispersion of the antimicrobial agent, especially in the case of metal particles, which tend to fall out of solution and may clump together during manufacturing, application, and/or use, thereby rendering an undesirable textile product having inadequate, uncontrolled, and/or non-durable antimicrobial activity, as well as defects such as weak tensile strength, high abrasiveness, and other undesirable properties.

Zeolite-based antimicrobial agents are widely used due to their low cost and colorless nature. Yet there are drawbacks to their use. The weight fraction of active ingredient tends to be very low (<5%) so the majority of additive is zeolite carrier. When used in textiles, the carrier can negatively impact the mechanical property of extruded fibers. Furthermore, the zeolite particles tend to be micron size, which limits the denier size of extrudable fiber, making the manufacture of fibers, such as microfibers, very difficult. Additionally, aqueous sodium ions accelerate the release of silver ions in zeolites, which occurs through ion exchange. Therefore, the durability of fabric substrates treated with zeolite agents is limited when washed in hard water wherein sodium ions are commonly exchanged for calcium ions by water softeners, or when contacted with salt solutions, such as human sweat and ocean water. Lastly, silver ions in the inner part of zeolite carrier particles may not be able to diffuse out of the carrier, rendering a fraction of the silver undeliverable and therefore ineffective as an antimicrobial and/or antifungal agent.

The use of metallic nanoparticles as antimicrobial and antifungal agents in textiles has been attempted, but success has been elusive due to clumping and other challenges to obtaining a controlled, uniform dispersion and concentration of the nanoparticles in the final textile product. Theoretically, the high surface area of nanoparticles offers an advantage over micron size antimicrobial and/or antifungal agents due to the nature of the ion release mechanism. The release mechanism involves hydromediated oxidation and dissolution of the metal surface, which consequently exposes a fresh metal. Furthermore, since the entire particle is metal, it can eventually be reduced to ions, and therefore serves as highly efficient antimicrobial and/or antifungal agent reservoir. Despite these advantages, metal nanoparticles have not been successfully incorporated into textiles to produce a product having desirable properties including durable antibacterial and/or antifungal biocidal activity after repeated use and washings.

For all these reasons, there exists a continuing and unmet need for improved textiles having antimicrobial and/or antifungal agents and for improved methods for their manufacture.

BRIEF SUMMARY

There are various approaches to producing nanoparticles, but the majority can be classified into grinding, solution based, and vacuum based synthesis methods. Grinding provides poor control of the size distribution and chemistries. The solution-based methodologies, typically salt reduction techniques, are very flexible in terms of types of materials that can be synthesized but have not heretofore developed into industrially robust processes for producing large quantities of particles. Solution based synthesis provides the most uniform distribution of nanoparticles and widest variety of surface chemistries. Vacuum based synthesis is much more amenable to metal oxide synthesis, but can be used to produce agglomerated nanoparticle powders. Methods for incorporating both solution based and vacuum based nanoparticles are described herein, although nanoparticles made by any method may be similarly utilized.

Early reduction-based synthesis of nanoparticles was conducted by Turkevich and co-workers in 1951 using citrate as the reducing agent to make gold nanoparticles with low polydispersity. These particles were stabilized by excess citrate to prevent agglomeration. Since Turkevich, considerable effort has been put into developing chemistries with better size dispersions, shape control and distance between the nanoparticles. It would be highly desirable to translate the level of synthetic control available for these particles into a predictable and controlled release of antimicrobial and/or antifungal agents in fabric substrates, and especially in fabric substrates at least partially comprised of synthetic fibers.

A number of methods for tuning the surface chemistry of nanoparticles have also been explored. The use of self-assembling monolayers ("SAM") has proven to be a robust and flexible method for modifying the surface chemistry. SAM molecules are typically composed of a reactive head group that binds to the surface of a nanoparticle and a tail group (R) which can have a variety of functionalities. For noble metals (e.g., Ag, Au, Pt, Pd, and Cu), organic molecules with amines, alcohols, carboxylic acids, ketones, vinylic groups, and mercapto-containing head groups can form well-organized capping layers. Accordingly, antimicrobial and/or antifungal nanoparticles thus functionalized may improve wash durability by providing tail groups that bind the nanoparticle to the textile.

Methods exist for bonding a metal particle to a textile, but generally require that the metal be bonded indirectly to the textile. For example, a powderized metal can be can suspended in a binder or adhesive. The textile is soaked in the binder-metal to cause the binder, and not the metal, to bond to the textile. However, this method is often inadequate for wash-durable antimicrobials because the binders are typically impermeable or not wash-fast, preventing the textile from being both wash durable and efficacious. Additionally, known binder methods impart undesirable properties to the finished textile, such as tackiness, stiffness, abrasiveness, and staining, for example.

Methods for extruding synthetic polymers with silver nanoparticles into fibers to be woven into textiles such as fabric substrates have been generally described, but such known methods do not adequately and consistently control dispersion of the nanoparticles, and do not produce a textile free from the undesirable properties previously described herein. Adequate and consistent controlled dispersion and substantially uniform concentration of nanoparticles is desirable for the manufacture and performance of washable, durable fabrics and textiles having nanoparticle antimicrobial agents. For example, controlled dispersion affects available antimicrobial surface area in finished textiles, and it prevents undesirable manufacturing problems such as slumping of expensive silver particles and associated clogging of extrusion equipment during manufacture of the fibers, fabrics, and textiles.

Known methods of manufacture of antibacterial and/or antifungal fibers, fabrics, and textiles fail to disclose or suggest several parameters, such as average particle sizes, particle size distributions, loading, and reservoir capacity, for example, to achieve a local metal ion concentration above the biocidal threshold during usage of the textile, even after repeated use and washing. The methods disclosed herein overcome these and other deficiencies.

Provided herein are antimicrobial textile substrates having a release rate matched to and/or correlated with the reservoir capacity of the antimicrobial/antifungal agent, thereby permitting local biocide concentrations above the biocidal threshold even after numerous uses and/or repeated washings. The new fabric substrates described herein possess a unique release profile with a minimized reservoir size, enabling the economical use of biocidal agents and mitigating, minimizing, or avoiding the potential mechanical and/or textural impact that the presence of the agent reservoir, as represented by nanoparticles bound to the polymers of the fabric substrate, may have on the fabric substrate.

Advantageously, the synthesis, characterization, and selection of the metal nanoparticles used as an antimicrobial/antifungal agent is sufficiently well understood so that the size of metal nanoparticle can be controlled to provide desirable qualities to the substrate. For example, it may be desirable to utilize particles having a preselected average particle size and associated narrow size distribution or deviation to provide predictable dispersion upon application and a controlled release of the applied agent, and/or to reduce relatively large or relatively small particle outliers that may cause clogging, clumping, or other undesirable behaviors of the nanoparticles during manufacturing and application to a substrate. By way of further example, it may be advantageous to provide two or more sets of antimicrobial/antifungal particles having distinct particle size ranges and/or particle size distributions. For example, it may be desirable to provide a set of smaller particles selected to impart a relatively fast release of an agent, and to provide a set of larger particles to impart a slower release of an agent. Additionally or alternatively, the type and nature of the particles may be selected to provide selected concentrations and/or rates of agent release on a finished textile and/or intermediate product such as fibers to be woven into a fabric to form the textile. As a result, through selection of particle size, particle composition, particle surface chemistry, particle dispersion, and particle quantity and concentration, antimicrobial agent release rate(s) can be controlled and correlated so that a desirable rate of ion release is provided to give a desired ion elusion profile that provides wash-durability and other desirable characteristics to finished textile products. Furthermore, the erosion model of metal ion release provided herein makes a greater number of ions available for release. In other words, where the nanoparticle includes only metal, none of the nanoparticle is inaccessible as a reservoir of antimicrobially active ions.

Another advantage is that, using the methods described herein, nanoparticles and their carriers generally will not clump, separate out of solution, or otherwise agglomerate to cause undesirable manufacturing problems commonly experienced with metal nanoparticles. As a result, for example, the methods avoid clogging of extrusion equipment such as spinneret heads during manufacture of synthetic fibers and other textiles.

Furthermore, using the methods herein, the surface of the metal nanoparticles can be functionalized to bind to polymers and/or cellulose based materials among others, thereby permitting control of the properties of the textile and the release properties of the nanoparticle and its inherent antimicrobial/antifungal agent, regardless of the composition of the textile.

In one embodiment, new methods are provided herein for manufacturing textiles having desirable antimicrobial and/or antifungal properties. For example, such methods may include, but are not limited to, the following steps:

providing a powder comprising a plurality of nanoparticles having antimicrobial and/or antifungal activity, such as silver and/or copper metal and/or metal oxide, the plurality of nanoparticles having at least one preselected average particle size range and at least one preselected particle size distribution within the at least one particle size range;

mixing the powder comprising the nanoparticles with a liquid comprising a reactive and/or block copolymer compatibilizer, such as using a dispersive mixer to form a liquefied nanoparticle/compatibilizer slurry;

pumping the liquefied nanoparticle/compatibilizer slurry into a polymer fed extruder, such as a twin screw extruder, and extruding pellets of nanoparticle/polymer composite, which composite is hereinafter referred to as a "masterbatch";

mixing the masterbatch with a base polymer to form a letdown polymer, and melt spinning the letdown polymer to obtain synthetic fibers; and optionally, weaving the synthetic fibers into a fabric substrate to yield desirable antimicrobial and/or antifungal characteristics that persist through a predetermined minimum number of launderings, for example, at least about 25 standard home launderings.

In another example utilizing relatively low melt polymers, for example, polymers melting below about 600 degrees Fahrenheit, and in another example below about 400 degrees Fahrenheit, the methods may include the steps of:

providing a powder comprising a plurality of nanoparticles having antimicrobial and/or antifungal activity, such as silver and/or copper metal and/or metal oxide, the plurality of nanoparticles having at least one preselected average particle size range and at least one preselected particle size distribution within the at least one particle size range;

mixing the metal nanoparticle powder with a low-melting reactive or block copolymer compatibilizer in a heated dispersive mixer;

cooling the resulting mixture to form a solid nanoparticle/compatibilizer composite;

granulating the nanoparticle/compatibilizer composite to form granules;

mixing nanoparticle/compatibilizer granules into a polymer fed extruder such as a twin screw extruder, and extruding pellets of the resulting nanoparticle/polymer composite, also referred to as a "masterbatch";

mixing the masterbatch with a base polymer to form a letdown polymer, and melt spinning the letdown polymer to obtain synthetic fibers; and optionally, weaving the synthetic fibers into a fabric substrate to yield desirable antimicrobial and/or antifungal characteristics that persist through a predetermined number of launderings, for example at least about 25 standard home launderings.

In yet another alternative embodiment, the methods comprise the following steps:

synthesizing silver and/or copper metal or metal oxide nanoparticles using Turkevich's method (e.g., reduction of a cationic metal source by citrate or ascorbic acid) or a variation thereof to form a colloidal nanoparticle solution having a plurality of nanoparticles having antimicrobial and/or antifungal activity, the plurality of nanoparticles having at least one preselected average particle size range and at least one preselected particle size distribution within the at least one particle size range;

optionally, functionalizing the silver and/or copper nanoparticles in the colloidal solution with a bifunctional molecule, the bifunctional molecule comprising at least one functional group capping the molecule and at least one second functional group selected to improve the miscibility of the nanoparticle with a selected synthetic polymer and/or to react with the selected synthetic polymer during extrusion;

adding, for example, slowly, the colloidal nanoparticle solution into a polymer fed extruder, such as a vented twin screw extruder;

permitting some or all of the solvent of the colloidal solution to evaporate and/or vaporize (e.g., drying) as the nanoparticles migrate into the polymer resin;

extruding pellets of nanoparticle/polymer composite, also referred to as a "masterbatch";

mixing the masterbatch with a base polymer to form a letdown polymer and melt spinning the letdown polymer to obtain synthetic fibers; and optionally weaving the synthetic fibers into a fabric substrate having desirable antimicrobial and/or antifungal characteristics that persist through a predetermined number of launderings, for example at least about 25 standard home launderings.

In still another embodiment, methods are provided for imparting wash-durable antimicrobial and/or antifungal characteristics on cellulose-based fabric substrates. In one embodiment, the method comprises the following steps:

providing at least one cellulose-based fabric substrate (e.g., cotton);

synthesizing silver and/or copper metal or metal oxide nanoparticles, such as by using Turkevich's method (e.g., reduction of a cationic metal source by citrate or ascorbic acid) or a variation thereof to provide a colloidal solution of nanoparticles having antimicrobial and/or antifungal activity, the plurality of nanoparticles having at least one preselected average particle size range and at least one preselected particle size distribution within the at least one particle size range;

functionalizing at least a portion of the nanoparticles with a bifunctional molecule, selected to include at least one functional group for capping the molecule and at least one second functional group, such as a cellulose dye group, selected to react with at least one selected functional group on the cellulose, to form a functionalized nanoparticle in a colloidal solution;

optionally, using drying methods to remove the solvent from the functionalized nanoparticle colloidal solution;

adding the nanoparticles, whether dried or in solution, to a cellulose dye bath;

reacting the cellulose dye group with the cellulose to bond the functionalized nanoparticle to the cellulose; and drying the cellulose fabric substrate, such as by pad drying, to yield an antimicrobial and/or antifungal fabric substrate having desirable antimicrobial and/or antifungal characteristics that persist through a predetermined number of launderings, for example at least about 25 standard home launderings.

Additional features, aspects, and advantages will become clear to one skilled in the art of textile manufacturing by carefully reading the following detailed description.

DETAILED DESCRIPTION AND EXAMPLE EMBODIMENTS

U.S. Federal law currently requires that a claim of antimicrobial or antifungal performance be substantiated according to standardized testing guidelines. All substrates denoted as "antimicrobial" herein can be said to be antimicrobial in that at least 99.9% (log 3) of bacteria are killed within 24 h in accordance with AATCC Test Method 100-2004. Testing was performed using a variety of bacteria including *Escherichia coli* (ATCC No. 2666) and *Staphylococcus aureus* (ATCC No. 6538). All substrates denoted as "antifungal" herein were determined to have no growth over 14 days in accordance to AATCC Test Method 030-2004 using *Aspergillus niger* (ATCC No. 6275).

An antimicrobial and/or antifungal fabric substrate has a release rate matched to and/or correlated with the reservoir capacity. In one embodiment, the antimicrobial substrate provides local biocide concentrations sufficient to kill 99.9% of bacteria in accordance with AATCC Test Method 100-2004 after a minimum of about 25 wash cycles, and in other examples more, such as 35 wash cycles, and even 50 wash cycles or more, in accordance with AATCC Test Method 135-2004, which test methods and standards are hereby incorporated by reference. The benefits of the antimicrobial textile substrates provided by the preset methods is that a release rate matched to the reservoir capacity provides local fungicide concentration sufficient to inhibit mold growth in accordance with AATCC Test Method 030-2004 after a minimum of about 25 wash cycles in accordance with AATCC Test Method 135-2004. Fabric substrates described herein possess a unique release profile with a minimized reservoir size, enabling the economical use of biocidal agents. Furthermore, the methods result in controlled particle dispersion and concentration in and on the substrate, thereby mitigating the potential mechanical, chemical, and/or textural impacts that the agent reservoir may have on the fabric substrate. For example, including impact on desirable properties of the substrate such as softness, pliability, elasticity, tensile strength, and other properties.

In one embodiment, a method for preparing antimicrobial and/or antifungal fabric substrates comprises the following steps:

providing a plurality of nanoparticles having antimicrobial and/or antifungal activity, the plurality of nanoparticles having at least one preselected average particle size range and at least one preselected particle size distribution within the at least one particle size range, for example, a powder of silver nanoparticles with an average particle size of about 1 nm to about 90 nm, powders of copper metal or metal oxide nanoparticles with a average particle size of about 1 nm to about 120 nm, and combinations thereof;

mixing, such as in a dispersive mixer, the provided nanoparticles with a liquid linear or block copolymer compatibilizer such as, for example: TONE 0201, a low molecular weight, linear polycaprolactone polyol; TONE 0301, a very low equivalent weight tri-functional liquid polyol; TONE 0305, a low equivalent weight tri-functional liquid polyol; and/or a reactive liquid compatibilizer such as EPOCROS WS-series and K-series oxazoline reactive polymers to form a liquefied nanoparticle/compatibilizer slurry;

pumping or otherwise conveying the liquefied nanoparticle/compatibilizer slurry into a polymer fed extruder, such as a vented twin screw extruder, fed with a polymer resin, such as polyester terephthalate ("PET"), polyester terephthalate glycol modified ("PETG") nylon-6, nylon-66, nylon-6, 66, polyurethane, polypropylene, polyethylene, polyvinyl chloride, poly(acrylonitrile butadiene styrene) and related polymers, derivatives, and combinations thereof;

extruding, such as to form pellets, the product from the previous step to form a nanoparticle/polymer composite, hereinafter designated as "masterbatch";

mixing the masterbatch with additional base polymer resin to form a letdown polymer, and melt spinning the resulting letdown polymer to obtain synthetic fibers; and optionally, weaving the synthetic fibers into a fabric substrate to yield antimicrobial and/or antifungal characteristics that persist after a minimum of about 25 wash cycles or more in accordance with AATCC Test Method 135-2004.

In yet another embodiment, the methods comprise the steps of:

providing a plurality of nanoparticles having antimicrobial and/or antifungal activity, the plurality of nanoparticles having at least one preselected average particle size range and at least one preselected particle size distribution within the at least one particle size range, for example, a powder of silver nanoparticles with an average particle size of about 1 nm to about 90 nm, powders of copper metal or metal oxide nanoparticles with a average particle size of about 1 nm to about 120 nm, and combinations thereof;

mixing, such as in a heated dispersive mixer, the nanoparticles and a low-melting linear or block copolymer or reactive compatibilizer such as FUSABOND® P SERIES (FUSABOND® is a registered trademark of E. I. du Pont de Nemours & Co. of Wilmington, Del.) functionalized polypropylenes, N SERIES nylon modifiers, E SERIES functionalized ethylene-based modifiers, C SERIES functionalized ethylene vinyl acetate ("EVA") based modifiers, A SERIES functionalized ethylene terpolymers, and combinations thereof;

cooling the product from the previous step to a solid to form a nanoparticle/compatibilizer composite, and granulating the nanoparticle/compatibilizer composite;

mixing the masterbatch nanoparticle/compatibilizer granules into an extruder, such as a twin screw extruder, fed with a polymer resin, such as polyester terephthalate ("PET"), polyester terephthalate glycol modified ("PETG") nylon-6, nylon-66, nylon 6,66, polyurethane, polypropylene, polyethylene, polyvinyl chloride, poly(acrylonitrile butadiene styrene), related polymers, and combinations thereof;

extruding pellets of nanoparticle/polymer composite, hereinafter designated as "masterbatch";

mixing the masterbatch with additional base polymer resin to form a letdown polymer, and melt spinning the resulting letdown polymer to obtain synthetic fibers; and optionally, weaving the synthetic fibers into a fabric substrate with antimicrobial and/or antifungal characteristics that persist after a minimum of about 25 wash cycles, or more in accordance with AATCC Test Method 135-2004.

In yet another embodiment, the methods comprise the following steps:

synthesizing silver and/or copper metal or metal oxide nanoparticles using Turkevich's method (e.g., reduction of a cationic metal source by citrate or ascorbic acid) or variations thereof to form metal-based nanoparticles having a desired average particle size range and distribution, as previously described herein;

mixing with the nanoparticles at least one solvent to suspend the nanoparticles as a colloidal suspension, for example using solvents including, but not limited to, water, dimethyl sulfoxide, ethanol, methanol, isopropanol, glycerol, diisooctyl phthalate, and mixtures and combinations thereof;

mixing to the product of the previous step at least one reducing agent including, but not limited to, sodium borohydride, sodium citrate, and combinations thereof;

optionally, functionalizing the nanoparticles with a bifunctional molecule, such as a molecule having at least one capping functional group such as, but not limited to, amines, alcohols, carboxylic acids, and/or mercapto groups, and further having at least one second functional group selected to improve the miscibility of the nanoparticle with polymer, such as, but not limited to, alkyl, allyl and/or benzyl groups, or selected to react with the synthetic polymer during extrusion, such as, but not limited to aldehydes, ketones, and/or vinylic groups;

slowly adding the solvated nanoparticle solution into the hopper of a vented twin screw extruder fed with polymer resin such as, but not limited to, polyester terephthalate ("PET"), polyester terephthalate glycol modified ("PETG") nylon-6, nylon-66, nylon 6,66, polyurethane, polypropylene, polyethylene, polyvinyl chloride, poly(acrylonitrile butadiene styrene) and related polymers and combinations thereof;

permitting at least a portion of the solvent to vaporize as the nanoparticles migrate into the polymer resin;

extruding pellets of nanoparticle/polymer composite, also referred to as "masterbatch";

mixing the masterbatch with a base polymer to form a letdown polymer, and melt spinning the resulting letdown polymer to obtain synthetic fibers; and optionally, weaving the synthetic fibers into a fabric substrate to yield antimicrobial and/or antifungal characteristics that persist after a minimum of about 25 wash cycles, in accordance with AATCC Test Method 135-2004.

Additionally, methods are provided for imparting wash-durable antimicrobial and/or antifungal characteristics on cellulose-based fabric that may be comprised of mixed cellulose-synthetic fabric fibers and/or substrates. An embodiment of the methods in one example comprises the following acts:

providing a mixed fabric substrate comprising more than about 1% cellulose-based fiber;

synthesizing silver and/or copper metal and/or metal oxide nanoparticles using Turkevich's method or a variation thereof, as previously described herein;

employing solvents including but not limited to water, dimethyl sulfoxide, ethanol, methanol, isopropanol, glycerol, diisooctyl phthalate, and mixtures thereof and reducing agents including but not limited to sodium borohydride, sodium citrate to yield a solution of suspended nanoparticles;

functionalizing the nanoparticles with at least one bifunctional molecule, the molecule including at least one capping functional group, such as amines, alcohols, carboxylic acids, mercapto, and combinations thereof, the molecule further including at least one second functional group selected to bond with cellulose, such as a cellulose dye group such as sulfones, dichlorotriazine, bis(aminonicotinotriazine), trichloropyrimidine, or bis(aminochlorotriazine), designed to react with specific functional groups on cellulose to form a functionalized nanoparticle solution;

optionally, using a drying method, such as for example evaporative, vacuum, spray or drum drying, to remove the solvent from functionalized nanoparticle solution;

adding the functionalized nanoparticles, whether dry or in solution, to a cellulose dye bath;

reacting the cellulose dye group with the cellulose to durably bond the functionalized nanoparticle to the cellulose; and pad-drying the cellulose fabric substrate to give an antimicrobial and/or antifungal fabric substrate with wash durability that persists after a minimum of about 25 wash cycles or more in accordance with AATCC Test Method 135-2004.

AATCC (American Association of Textile Chemists and Colorists) Test Method 100-2004, entitled "Assessment of Antibacterial Finishes on Textile Materials," is incorporated herein by reference in its entirety. A copy of this AATCC Test Method is included in the file history of this patent application. Briefly, swatches of test and control textile materials are tested quantitatively for antibacterial activity. Test and control swatches are inoculated with the test organisms (e.g., with *S. aureus*). After incubation, the bacteria are eluted from the swatches by shaking in known amounts of neutralizing solution. The number of bacteria present in this liquid is determined, and the percentage reduction by the treated specimen is calculated.

AATCC Test Method 030-2004, entitled "Antifungal Activity, Assessment on Textile Materials: Mildew and Rot Resistance of Textile Materials," is incorporated herein by reference in its entirety. A copy of this AATCC Test Method is included in the file history of this patent application. This procedure is generally considered to be the most severe test for textile products. This test method determines the susceptibility of textile materials to mildew and rot and evaluates the efficacy of antimicrobial or antifungal agents on textile materials. Briefly, the method includes encouraging a microorganism to grow on a test textile, followed by measuring the resulting decrease in breaking strength versus an untreated control sample.

AATCC Test Method 135-2004, entitled "Dimensional changes of Fabrics after Home Laundering," is incorporated herein by reference in its entirety. A copy of this AATCC Test Method is included in the file history of this patent application. This test method provides a protocol for measuring the response of textiles to standardized home laundering procedures representative of those typically used by consumers. Four washing temperatures, three agitation cycles, two rinse temperatures, and four drying procedures cover the common home care options available to consumers using current laundering machines. Laundering of textile materials, refers to a process intended to remove soils and/or stains by treatment (washing) with an aqueous detergent solution and normally including rinsing, and extraction (in addition to drying). Laundering is typically carried out by machine. The wash-durable fabric substrates described herein typically retain their antimicrobial or antifungal properties after being laundered in accordance with AATCC Test Method 135-2004 after a minimum of 15, 20, 25, 30 or more wash cycles.

Accordingly, in an embodiment, a wash-durable fabric substrate comprises at least 1% synthetic polymer fiber by weight of the total weight of the substrate, wherein the substrate includes an antimicrobial/antifungal agent that exhibits at least a 24 h kill rate of 99.9% for bacteria (e.g., when tested by AATCC Test Method 100-2004), and wherein the wash-durable fabric substrate retains antimicrobial or antifungal properties are further exhibited after said test wash-durable fabric has been laundered and dried (e.g., in accordance with AATCC Test Method 135-2004) after a minimum of 25 wash cycles. In another embodiment, the wash-durable fabric substrate comprises from about 0.005% to about 0.075% silver by weight of the total weight of said substrate. In yet another embodiment, the silver is in the form of nanoparticles with an average particle size of from about 1 nm to about 90 nm. In still another embodiment, the substrate consists essentially of one or more synthetic polymers and an antimicrobial/antifungal agent. In another embodiment, the substrate is comprises a blend of at least one synthetic polymer and cotton. In yet another embodiment, the wash-durable fabric the fabric exhibits a 14-day no growth rating (e.g., when tested by AATCC Test Method 030-2004), and wherein the no growth rating is maintained after said fabric has been laundered and dried (e.g., in accordance with AATCC Test Method 135-2004) after a minimum of about 25 wash cycles. In another embodiment, the substrate comprises from about 0.010% to about 0.50% copper by weight of the total weight of the substrate. In another embodiment, the copper is copper metal or metal copper oxide in the form of nanoparticles with an average particle size of from about 1 nm to about 120 nm. In still another embodiment, the substrate consists essentially of one or more synthetic polymers and an antimicrobial/antifungal agent. In another embodiment, the substrate is a blend of one or more synthetic polymers, and cotton, and an antimicrobial/antifungal agent.

In another embodiment, a wash-durable fabric substrate comprises at least 1% cotton fiber by weight of the total weight of said substrate, wherein said substrate exhibits at least a 24 h kill rate of 99.9% for bacteria (e.g., when tested by AATCC Test Method 100-2004); wherein the kill rate is maintained after said test fabric has been laundered and dried (e.g., in accordance with AATCC Test Method 135-2004) after a minimum of about 25 wash cycles. In another embodiment, the substrate comprises from about 0.005% to about 0.035% silver by weight of the total weight of the substrate. In still another embodiment, the silver is in the form of nanoparticles with an average particle size of from about 1 nm to about 90 nm. In another embodiment, the substrate consists essentially of cotton and an antimicrobial/antifungal agent. In still yet another embodiment, the substrate comprises a blend of cotton and at least one synthetic polymer. In another embodiment, the fabric exhibits a 14-day no growth rating (e.g., when tested by AATCC Test Method 030-2004), wherein the no growth rating is maintained after the fabric has been laundered and dried (e.g., in accordance with AATCC Test Method 135-2004) after a minimum of about 25 wash cycles. In another embodiment, the substrate comprises from about 0.005% to about 0.40% copper metal or metal oxide by weight of the total weight of said substrate. In another embodiment, the copper is in the form of nanoparticles with an average particle size of from about 1 nm to about 120 nm. In still another embodiment, the substrate consists essentially of cotton and an antimicrobial/antifungal agent. In another embodiment, the substrate comprises a blend of cotton and at least one synthetic polymer.

Although some embodiments and examples described herein are shown to include certain features, one skilled in the art will appreciate that features disclosed herein may be used together or in combination with other features of any embodiment, including substitution of equivalent materials, equipment, methods, and the like. Furthermore, it is within the ordinary skill of the artisan to modify the teaching hereof to exclude certain features or elements from any embodiment without departing from the essential purpose or spirit thereof. Furthermore, while the methods and materials have been described with reference to preferred embodiments, it will be understood by those skilled in the art that various changes may be made and equivalents may be substituted for elements thereof, or in some cases the order of method steps may be changed (or steps combined), without departing from the scope of this disclosure. In addition, many modifications may be made to adapt a particular situation or material to the teachings hereof without departing from their essential scope. Therefore, it is intended that the following claims not be limited to any particular embodiments specifically disclosed or exemplified, but that the invention will include all embodiments falling within the scope of the appended claims.

What is claimed is:

1. A wash-durable fabric substrate comprising at least 1% synthetic polymer fiber by weight of the total weight of said substrate, wherein said substrate includes an antimicrobial/antifungal agent that exhibits at least a 24 h kill rate of 99.9% for bacteria, and wherein said wash-durable fabric substrate retains antimicrobial or antifungal properties after said wash-durable fabric has been laundered and dried after a minimum of 25 wash cycles, wherein the synthetic polymer fiber comprises an extrusion of a substantially uniform mixture of at least one polymer and silver nanoparticles, wherein the polymer fiber comprises from about 0.005% to about 0.075% silver by weight.

2. The wash-durable fabric substrate of claim 1, wherein said substrate comprises from about 0.005% to about 0.075% silver by weight of the total weight of said substrate.

3. The wash-durable fabric substrate of claim 2, wherein said silver nanoparticles have an average particle size of from about 1 nm to about 90 nm.

4. The wash-durable fabric substrate of claim 1, wherein said synthetic polymer fiber consists essentially of one or more synthetic polymers and an antimicrobial/antifungal agent.

5. The wash-durable fabric substrate of claim 1, wherein said substrate comprises a blend of at least one synthetic polymer and cotton.

6. The wash-durable fabric substrate of claim 1, wherein the fabric exhibits a 14-day no growth rating, and wherein the no growth rating is maintained after said fabric has been laundered and dried after a minimum of about 25 wash cycles.

7. The wash-durable fabric substrate of claim 6, wherein said substrate comprises from about 0.010% to about 0.50% copper by weight of the total weight of said substrate.

8. The wash-durable fabric substrate of claim 7, wherein said copper is copper metal or copper oxide in the form of nanoparticles with an average particle size of from about 1 nm to about 120 nm.

9. The wash-durable fabric substrate of claim 6, wherein said substrate consists essentially of one or more synthetic polymers and an antimicrobial/antifungal agent.

10. The wash-durable fabric substrate of claim 6, wherein said substrate is a blend of one or more synthetic polymers, cotton, and an antimicrobial/antifungal agent.

11. A wash-durable fabric substrate comprising at least 1% cotton fiber by weight of the total weight of said substrate, wherein said substrate exhibits at least a 24 h kill rate of 99.9% for bacteria; wherein the kill rate is maintained after said fabric has been laundered and dried after a minimum of about 25 wash cycles, wherein the substrate comprises a synthetic polymer fiber that comprises an extrusion of a substantially uniform mixture of at least one polymer and silver nanoparticles, and wherein the polymer fiber comprises from about 0.005% to about 0.075% silver by weight.

12. The wash-durable fabric substrate of claim 11, wherein said substrate comprises from about 0.005% to about 0.035% silver by weight of the total weight of said substrate.

13. The wash-durable fabric substrate of claim 12, wherein said silver nanoparticles have an average particle size of from about 1 nm to about 90 nm.

14. The wash-durable fabric substrate of claim 11, wherein said synthetic polymer fiber consists essentially of polymer and an antimicrobial/antifungal agent.

15. The wash-durable fabric substrate of claim 11, wherein said substrate consists of a blend of cotton and at least one synthetic polymer.

16. The wash-durable fabric substrate of claim 11, wherein the fabric exhibits a 14-day no growth rating, wherein the no growth rating is maintained after said fabric has been laundered and dried after a minimum of about 25 wash cycles.

17. The wash-durable fabric substrate of claim 16, wherein said substrate comprises from about 0.005% to about 0.40% copper metal or metal oxide by weight of the total weight of said substrate.

18. The wash-durable fabric substrate of claim 17, wherein said copper is in the form of nanoparticles with an average particle size of from about 1 nm to about 120 nm.

19. The wash-durable fabric substrate of claim 16, wherein said substrate further comprises cotton and an antimicrobial/antifungal agent.

20. The wash-durable fabric substrate of claim 16, wherein said substrate consists of a blend of cotton and at least one synthetic polymer.

21. The substrate of claim 1, wherein substantially all of the antimicrobial/antifungal agent is comprised in the synthetic polymer fiber, and wherein the polymer and nanoparticles mixture of the synthetic polymer fiber provides predictable and controlled release of the antimicrobial/antifungal agent over time.

22. The substrate of claim 11, wherein substantially all of the antimicrobial/antifungal agent is comprised in the synthetic polymer fiber, and wherein the polymer and nanoparticles mixture of the synthetic polymer fiber provides predictable and controlled release of the antimicrobial/antifungal agent over time.

23. The wash-durable fabric substrate of claim 1, made by a method comprising the steps of:

providing a powder comprising silver nanoparticles having an average particle size of less than about 90 nm;

mixing the silver nanoparticles with a low-melting reactive or block copolymer compatibilizer to form a mixture;

cooling the mixture to form a solid nanoparticle/compatibilizer composite;

granulating the nanoparticle/compatibilizer composite to form granules;

mixing the granules into a polymer fed extruder to form a nanoparticle/polymer composite masterbatch;

mixing the masterbatch with a base polymer to form a letdown polymer; and melt spinning the letdown polymer to obtain the synthetic polymeric fiber for incorporation into the wash-durable fabric substrate.

24. The wash-durable fabric substrate of claim 11, made by a method comprising the steps of:

providing a powder comprising silver nanoparticles having an average particle size of less than about 90 nm;

mixing the silver nanoparticles with a low-melting reactive or block copolymer compatibilizer to form a mixture;

cooling the mixture to form a solid nanoparticle/compatibilizer composite;

granulating the nanoparticle/compatibilizer composite to form granules;

mixing the granules into a polymer fed extruder to form a nanoparticle/polymer composite masterbatch;

mixing the masterbatch with a base polymer to form a letdown polymer; and melt spinning the letdown polymer to obtain the synthetic polymeric fiber for incorporation into the wash-durable fabric substrate.

* * * * *